US006533866B1

(12) United States Patent
Franz et al.

(10) Patent No.: US 6,533,866 B1
(45) Date of Patent: Mar. 18, 2003

(54) METHOD AND DEVICE FOR THE AUTOMATED APPLICATION OF A BEAD OF ADHESIVE

(75) Inventors: Marco Franz, Sindelfingen (DE); Jürgen Schuhmann, Sindelfingen (DE)

(73) Assignee: DaimlerChrysler AG, Stuttgart (DE)

( * ) Notice: Subject to any disclaimer, the term of this patent is extended or adjusted under 35 U.S.C. 154(b) by 124 days.

(21) Appl. No.: 09/634,557

(22) Filed: Aug. 9, 2000

(30) Foreign Application Priority Data

Aug. 12, 1999 (DE) ..... 199 38 328

(51) Int. Cl.[7] ..... B05C 11/00
(52) U.S. Cl. ..... 118/712; 118/410; 118/671
(58) Field of Search ..... 118/671, 712, 118/410, 669; 156/356, 578

(56) References Cited

U.S. PATENT DOCUMENTS

| | | | | |
|---|---|---|---|---|
| 3,153,109 A | | 10/1964 | Steventon et al. | |
| 3,217,204 A | | 11/1965 | Nance | |
| 3,596,050 A | | 7/1971 | Tikijian | |
| 4,762,578 A | * | 8/1988 | Bargin, Jr. et al. | |
| 5,322,566 A | | 6/1994 | Satoh et al. | |
| 5,437,727 A | * | 8/1995 | Yoneda et al. | 118/712 |

FOREIGN PATENT DOCUMENTS

| | | |
|---|---|---|
| DE | 1941 728 | 3/1971 |
| DE | 28 29 851 A1 | 1/1980 |
| DE | 93 03 857.7 | 6/1993 |
| DE | 42 07 840 C2 | 3/1995 |
| JP | 3-161076 | 11/1991 |

* cited by examiner

*Primary Examiner*—Brenda A. Lamb
(74) *Attorney, Agent, or Firm*—Crowell & Moring LLP

(57) ABSTRACT

To control the distance between an adhesive application device and a joining surface during the application of a bead of adhesive, the distance between the application nozzle and the joining surface is measured with the aid of a contactless measurement method, and application nozzle and joining surface are moved with respect to one another in such a way that the distance measured value lies within a predetermined, adjustable range of values.

9 Claims, 3 Drawing Sheets

METHOD AND DEVICE FOR THE AUTOMATED APPLICATION OF A BEAD OF ADHESIVE

BACKGROUND OF THE INVENTION

1. Field of the Invention

The invention relates to a method and device for the automated application of a bead of adhesive to a joining surface wherein the distance between an adhesive application nozzle and the joining surface is measured with contactless measurement.

2. Description of Prior Developments

A method for the automated application of adhesive, sealing compounds, etc. to a joining surface is known, for example, from the generic DE 930 38 57 U1. In this method, an approximately planar joining surface is guided past the adhesive-application nozzle 9 at a predetermined distance from the outlet opening. Furthermore, electromagnetic distance-measuring systems for guiding welding and cutting machines at a predetermined distance from a metallic surface are known from U.S. Pat. Nos. 3,153,109, 3,217,204, 3,596,050, DE 1 941 728 and DE 28 29 851.

In the automotive sector, in particular in the body shell sector, particularly high demands are placed on adhesive bonds with regard to structural strength and sealing requirements. To produce a sealed, cleanly positioned adhesive bond, in addition to accurate metering of the amount of adhesive, the positioning of the bead of adhesive in particular plays an important role. While the amount of adhesive can be determined and monitored highly accurately with the aid of a metering control system, exact positioning of the bead of adhesive requires the distance between the application nozzle for the bead of adhesive and the joining surface to be maintained very accurately.

If the distance between the outlet opening and the joining surface is too great, considerable fluctuations in the position of the bead of the adhesive on the joining surface occur, so that it is impossible to achieve a well-defined positioning of the bead of the adhesive; on the other hand, if the distance between the outlet opening and the joining surface is too short, the bead of adhesive is squashed and loses its original round profile. A process which reliably maintains the optimum distance between outlet opening and joining surface during the automated application of a bead of adhesive to an undulating, three-dimensional joining surface which is subject to manufacturing tolerances can only be achieved if the process is accompanied by measurement of the distance between the application nozzle and joining surface and if the measured value thus obtained is used to control the distance.

SUMMARY OF THE INVENTION

The invention is therefore based on the object of proposing a method and a compact device with which beads of adhesive can be applied in a clean, reproducible manner to a joining surface.

An adhesive head includes a sensor which measures the distance of the outlet opening from the joining surface and compares this distance with a desired value. With the aid of the device according to the invention, it is possible to apply beads of adhesive with a high level of accuracy—irrespective of fluctuations in the component geometry—even to workpieces which are of complicated shape, while achieving a 100% seal in the adhesive bond and a high strength in particular on structural components. This leads to a reduction in scrap and therefore to a considerable cost saving compared to conventional adhesive systems. The highly accurate, reproducible positioning of the bead of adhesive with the aid of the method according to the invention moreover allows the adhesive-bonding technique to be employed in bodywork part areas which are difficult to access. Furthermore, the reliability of the process for applying the bead of adhesive allows this method to be used for the adhesive bonding of workpieces which are relevant from a safety aspect, in particular for the adhesive bonding of rebate edges, on which high demands are placed both with regard to strength and with regard to the seal provided.

To achieve an accurate, reproducible measurement result, it is expedient to use an inductive sensor. Unlike a capacitive sensor, which may supply incorrect measured values and therefore may result in an incorrect distance measurement if, for example if the nozzle becomes smeared, an irregular amount of adhesive passes between joining surface and sensor, and which therefore is of only limited suitability for distance measurements in adhesive applications, this inductive sensor still allows highly accurate, reproducible measured values to be obtained even if it is contaminated by adhesive.

The sensor and application nozzle are expediently mounted together on the movable carriage of a displacement unit, with the aid of which they can be displaced together approximately perpendicular to the joining surface. The actual distance of the sensor from the component surface, corresponding to the measurement signal, is compared with an adjustable set distance and the carriage is moved, as a function of the difference, in such a way that the distance between the application nozzle and the joining surface approximately corresponds to the desired distance throughout the entire adhesive-bonding operation.

Particularly accurate control of the distance between the application nozzle and joining surface is achieved if the distance sensor is fixedly connected to the application nozzle and is situated close to the outlet opening. The proximity of the sensor to the joining surface in this case results in a signal which is particularly sensitive with regard to distance and enables a direct conclusion to be drawn as to the position of the outlet opening with respect to the joining surface, thus ensuring rapid feedback. Furthermore, this allows the adhesive-bonding device to be of compact design. It is thus possible to apply beads of adhesive even along complicated paths, requiring multidimensional displacement and pivoting of the adhesive-bonding device with respect to the joining surface, without any collisions. In order in this case —irrespective of the curve of the path and direction of displacement of the adhesive-bonding device with respect to the joining surface—to ensure a uniform measurement signal from the sensor, the sensor is advantageously designed in such a way that it surrounds the application nozzle in the form of a ring.

For the automated application of a bead of adhesive to a workpiece of complicated shape, it is advantageous to move the workpiece with respect to the adhesive-bonding device along the desired path of adhesion with the aid of a NC manipulator. In the process, the manipulator positions the workpiece in such a way that the (fixed) direction of displacement of the adhesive-bonding device at all times is approximately perpendicular to that area of the joining surface which lies opposite the application nozzle. The measured values from the sensor are thus used to rapidly control the vertical distance between the joining surface and the outlet opening and thus compensate for tolerances in the workpiece, while the path of the workpiece in the horizontal direction, which is less relevant in terms of accuracy, is determined by the manipulator.

BRIEF DESCRIPTION OF THE DRAWINGS

In the following text, the invention is explained with reference to an exemplary embodiment which is illustrated in the drawings, in which.

DETAILED DESCRIPTION OF THE PREFERRED EMBODIMENT

Figure 1:
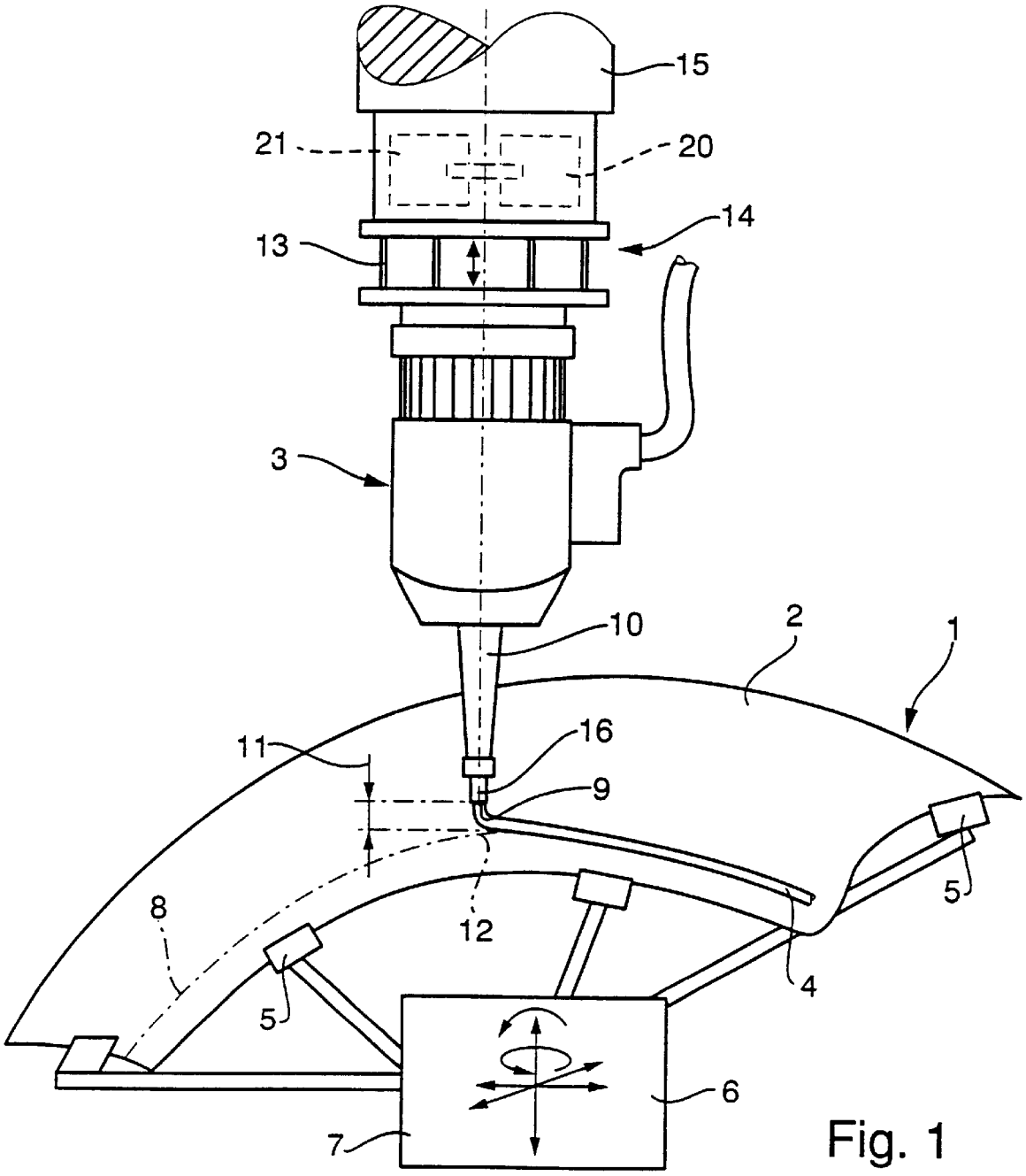
FIG. 1 shows a view of an application device which applies adhesive to a workpiece which is clamped on a manipulator.

FIG. 1 shows a workpiece with a metallic joining surface 2, to which a bead of adhesive 4 is to be applied in defined areas with the aid of an application device 3. For this purpose, the workpiece 1 is attached in a reproducible position, with the aid of clamping elements 5, to a manipulator 6, by means of which the workpiece 1 can be displaced, rotated and pivoted in different directions in all three dimensions with respect to the application device 3. This manipulator 6 is expediently an industrial robot 7 which is programmed in such a way that it moves the joining surface 2 of the workpiece 1 past the application device 3 along the desired adhesive path 8.

The bead of adhesive 4 is applied to the joining surface 2 by the application device 3 via an application nozzle 10 and an outlet opening 9 at the end of an application device 3. To ensure that the bead of adhesive 4 provides high-quality bonding of the workpiece 1, the distance 11 between outlet opening 9 and joining surface 2 during the application of the bead of adhesive 4 must lie within tight limits around a desired distance. This is because if the outlet opening 9 is too close to the joining surface 2, the bead of adhesive 4 is squashed to a considerable extent and the round profile of the bead of adhesive 4, which is required for a good bonding result, is lost. Furthermore, contact between the application device 3 and the joining surface 2 may lead to damage to the joining surface 2. On the other hand, if the outlet opening 9 is too far away from the joining surface 2, this leads to undefined deviations in the position of the bead of adhesive 4 from the desired adhesive path 8 on the joining surface 2. Both cases lead to an unsatisfactory bonding result and must therefore be avoided. In the case of a bead of adhesive 4 with a diameter of 3 mm, the desired distance is between 2.5 mm and 3.5 mm.

If the joining surface 2 of the workpiece 1 deviates from the desired geometry, for example as a result of moulding errors, or the position of the workpiece deviates from the desired position on the manipulator 6, the result is that the joining surface 2 becomes offset from the faultless, ideal joining surface. This offset has to be compensated for by moving the outlet opening 9 of the application device 3 and the joining surface 2 closer to or further away from one another, so that the actual distance between the outlet opening 9 and the opposite area 12 of the joining surface 2 continues to correspond to the desired distance, so that a high-quality bead of adhesive 4 can be applied.

Figure 2:
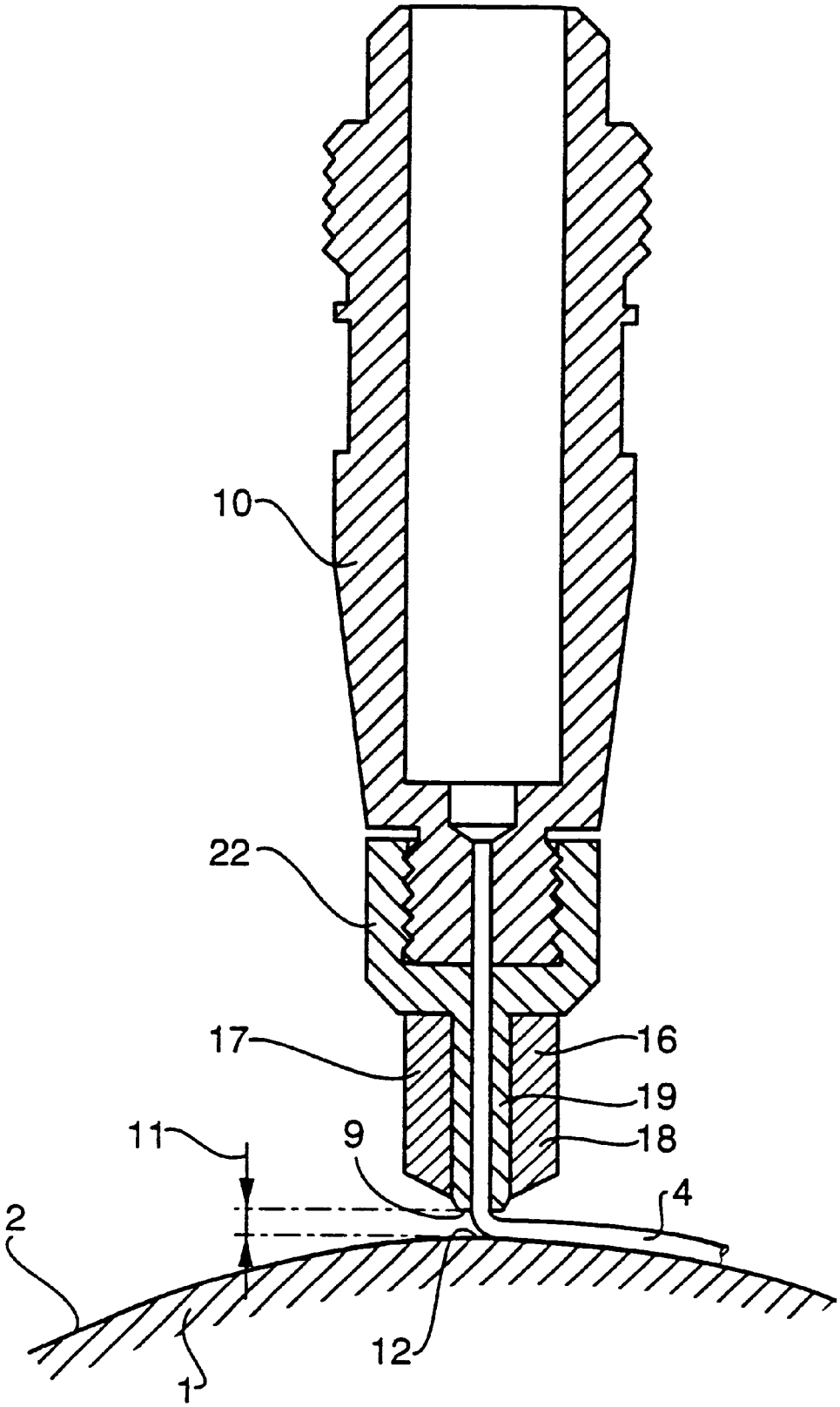
FIG. 2 shows a detailed view of the application device with application nozzle and induction sensor.

To carry out the distance control required to achieve this, the application device 3 is attached to a movable carriage 13 of a displacement unit 14 which, for its part, is fitted on a fixed attachment device 15 and with the aid of which, as indicated by arrows in FIG. 1, the application device 3 can be displaced in the direction of the axis of symmetry of the application device 3. Furthermore, as shown in FIG. 2, a sensor 16 is mounted on the application device 3, with the aid of which sensor the current distance 11 between the outlet opening 9 and the metallic joining surface 2 is measured. In the present exemplary embodiment, the sen 16 is an induction sensor 17, the induction coil 18 of which surrounds that end 19 of a spacer 22 mounted on the application nozzle 10 which lies opposite the joining surface 2 in the form of a ring and is thus situated in the immediate vicinity of the outlet opening 9. With the aid of sensor electronics 20, the actual distance 11 between outlet opening 9 and the opposite area 12 of the joining surface 2 is determined from the measured value from the induction sensor 17 and is compared with the desired distance. The difference between the actual and desired distances is transmitted to a control system 21, which then displaces the movable carriage 13 of the displacement unit 14, and therefore also the application nozzle 10, until this difference is compensated for and thus the actual distance 11 corresponds to the desired distance. This control has to take place very quickly—compared to the movement of the workpiece 1 along the path—so that the vertical adjustment of the application device 3 is carried out so quickly, even in steep areas of the joining surface 2, that the actual difference 11 between outlet opening 9 and joining surface 2 at any time only deviates slightly from the desired distance.

The embodiment of the induction sensor 17 which is illustrated in FIG. 2, having an induction coil 18 which surrounds the spacer 22 in the form of a ring, enables the sensor 16 on the application device 3 to be of very compact design. The entire sensor electronics 20—as indicated in FIG. 1—is shifted out of the immediate vicinity of the application nozzle 10, into the area of the displacement unit 14, and therefore takes up no space in the vicinity of the outlet opening 9. The application device 3 provided with the induction sensor 17 is thus able to position a bead of adhesive 4 without collisions even within very tight spatial conditions.

To allow the adhesive which has been heated up in the interior of the application device 3 to be placed onto the joining surface 2 at a well-defined temperature, the application nozzle 10 consists of a metallic material which has a high thermal conductivity and therefore ensures that the elevated temperature which is required for application of the adhesive is maintained all the way to the outlet opening 9. The induction coil 18 of the induction sensor 17 is shielded from this metallic application nozzle 10 by the nonmetallic annular spacer 22 (which is made, for example, from a plastic material). As a result, inductive signals from the application nozzle 10 are reduced and thus the signal-to-noise ratio of the induction sensor 17 is improved. As an alternative, the application nozzle 10 itself may be made from a material (e.g. aluminium) which differs from the material of the joining surface 2 which is to be treated (e.g. steel sheet).

To achieve a reproducible bonding result, the manipulator 6 guides the workpiece 1 past the application device 3 in such a manner that that region 12 on the workpiece 1 which lies opposite the outlet opening 9 is approximately perpendicular to the feed direction of the displacement unit 14. The accuracy of the described distance control which can be reproducibly achieved is better than 0.1 mm. Therefore, the accuracy of the application of adhesive is significantly higher in the direction normal to the joining surface 2 than the application accuracy (which is less critical for the bonding result) in the tangential direction with respect to the joining surface 2, which is determined by the deviations in the workpiece geometry from the desired geometry and/or by the accuracy with which the workpiece 1 is clamped in the manipulator 6.

Figure 3A:
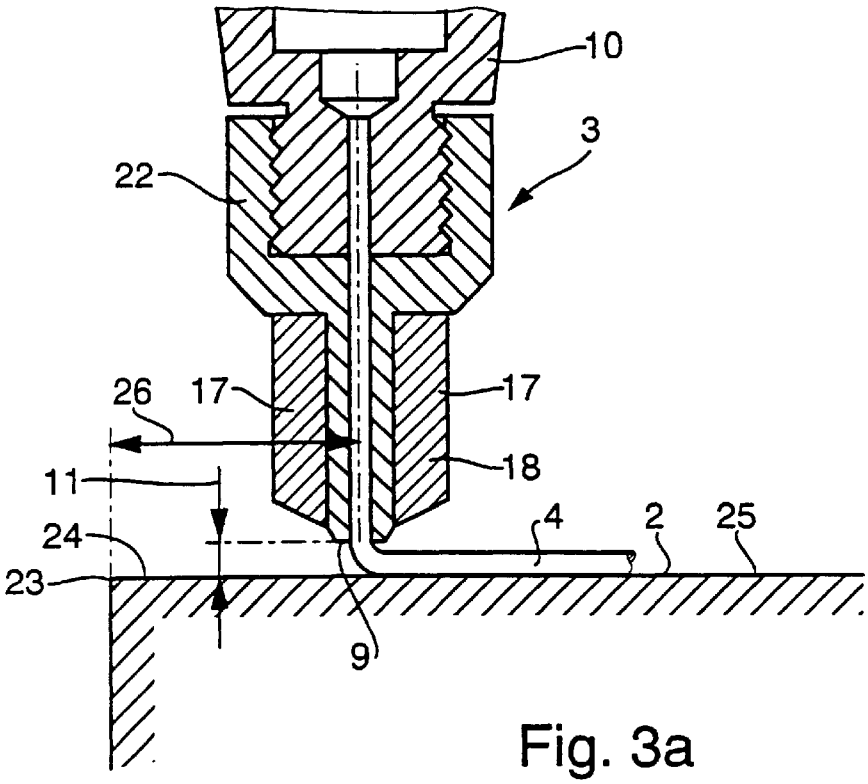
FIG. 3*a* shows a view of the application device in the vicinity of an edge of the workpiece.
Figure 3B:
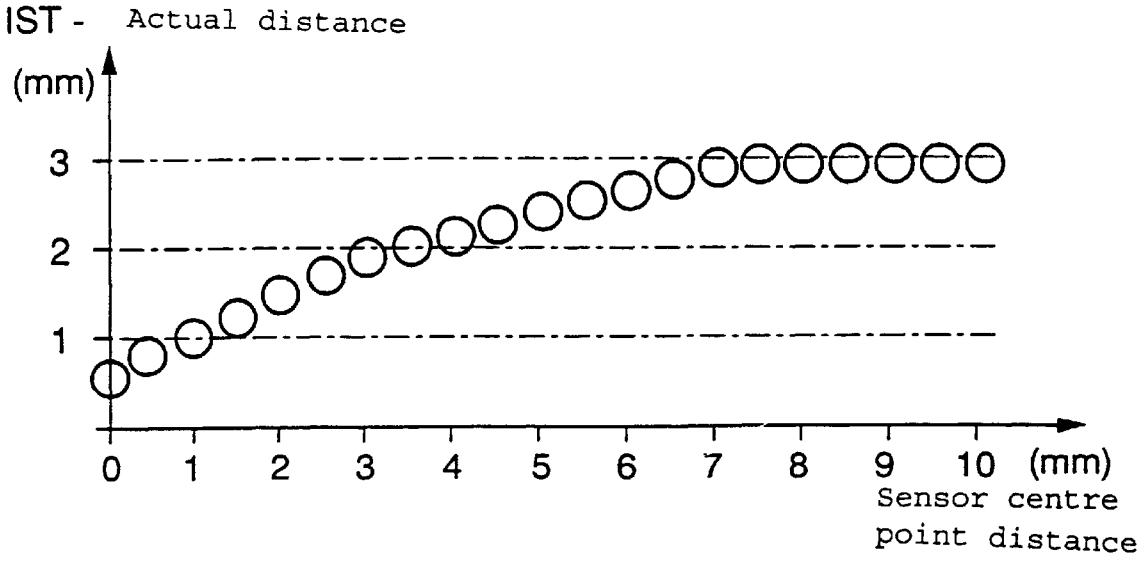
FIG. 3*b* shows a graph illustrating the variation in distance between sensor and workpiece surface when the application device approaches the edge.

If the application device 3 approaches an edge 23 of the metallic joining surface 2 (cf. FIG. 3*a*), a smaller part of the area of the joining surface 2 is situated in the measurement area of the induction coil 18 in the vicinity of the edge 24 compared to in areas 25 which are remote from the edges. This has the same effect on the measured value from the induction sensor 17 as an excessive actual distance 11, and the control system 21 reacts by attempting to compensate for this apparent deviation in distance, and therefore the application device 3 moves closer to the joining surface 2. Thus, as is diagrammatically illustrated in FIG. 3*b*, approaching an edge 23 leads to an excessive reduction in the actual distance 11 and thus to the bead of adhesive 4 becoming squashed. In the example shown in FIG. 3*b*, the desired distance is 3 mm; when the application nozzle 10 is well away from the edge 23, the actual distance 11 between outlet opening 9 and joining surface 2 accurately corresponds to this distance. When the application nozzle 10 is closer than approximately 8 mm from the edge 23, the actual distance 11 decreases continuously as the nozzle moves closer to the edge 23, until ultimately, when the edge 23 is reached, this distance is only 0.5 mm.

This effect can be avoided if the control system 21 of the induction sensor 17 is provided with information concerning the edges 23 which occur along or in the vicinity of the desired adhesive path 8 while the path is being programmed into the manipulator 6. It is then possible to actively compensate for the above-described effect at the appropriate points along the desired adhesive path 8 and to ensure a constant actual distance 11 between outlet opening 9 and joining surface 2, even in the region of edges 23. In a similar way, it is possible to compensate for the influences of flanges on the adhesive-application distance.

The described classification of the movement axes, according to which a manipulator 6 moves the workpiece 1 along a desired adhesive path 8 while the fine tuning of the distance is carried out using a displacement device 14 on the application device 3 is particularly advantageous, since it separates the relatively rough and slow manipulator movements from the highly accurate, quick-reacting distance-control operations carried out by the displacement device 14. The application device 3 is relatively small and lightweight and can therefore be moved quickly and easily by the displacement device 14. The comparatively large and heavy workpieces 1, by contrast, have a higher mass moment of inertia and should preferably be moved along slower paths; they are therefore suitable for positioning using the comparatively slow-moving manipulator 6.

Alternatively, however, it may, depending on the workpiece geometry, quite possibly be advantageous, for reasons of spatial accessibility, to carry out the path movement and distance fine tuning together or separately on the workpiece 1 and/or on the application device 3. In particular, for certain designs of the unit, it may be advantageous to fix the workpiece 1 in a stationary position and to apply the bead of adhesive 4 with the aid of the manipulator 6, for example a robot 7. In this case, both the application device 3 and the displacement device 14 are mounted on the robot 7, and the robot 7 guides the application device 3 at a predetermined distance from the joining surface 2 on the stationary workpiece 1.

With the aid of the application device 3 according to the invention which is fitted with an inductive sensor 17, it is possible to treat joining surfaces 2 made from a wide range of metallic materials. In particular, the device is suitable for applying beads of adhesive 4 to sheets of steel, aluminium and magnesium. Application examples include all workpieces which are to be adhesively bonded and for which the strength and seal provided by the adhesive bond is of a high level of importance, for example, in the automotive sector, door parts, rear hood lid parts, dashboard bonding and bonding the side wall to the floor panel.

In addition to the inductive sensor 17 described here, it is in principle also possible to use capacitive and optical sensors to measure the distance from the outlet opening 9 to the joining surface 2. Capacitive sensors measure the capacitance between a capacitor of the sensor and the metallic joining surface 2 of the workpiece 1 and, from these measured values, determine the actual distance 11. They are very sensitive in terms of their reaction to changes in the dielectric constant of the medium situated between the sensor and the workpiece surface. Smeared adhesive on the sensor therefore leads to incorrect measurements of the actual distance 11 and must be avoided. When using an optical sensor, it is also necessary to ensure that the optical elements of the sensor are not smeared with adhesive, since otherwise incorrect measurements occur.

What is claimed is:

1. A device for the automated application of a bead of adhesive to a joining surface, the device comprising an application nozzle with an outlet opening which applies the bead of adhesive to the joining surface without the application nozzle coming into contact with the joining surface, and a sensor on the device for the contactless measurement of the distance between the outlet opening and the joining surface;

wherein the sensor comprises an inductive sensor with an induction coil which surrounds the application nozzle in the form of a ring.

2. The device according to claim 1, wherein the sensor is immovably connected to the application nozzle and is arranged in the vicinity of the outlet opening of the application nozzle.

3. The device according to claim 1, further comprising a movable carriage and wherein the application nozzle and the sensor are mounted together on the movable carriage which is displaceable in the direction of the axis of symmetry of the application nozzle.

4. A device for automated joining of at least two machining surfaces to one another comprising:

a joining adhesive;

an application nozzle with an outlet opening for applying a bead of said joining adhesive to one of said at least two machining surfaces; and a sensor for contactless measurement of a distance between the outlet opening and said one machining surface mounted on the application nozzle at the outlet opening.

5. The device according to claim 4, wherein the sensor is immovably connected to the application nozzle.

6. The device according to claim 4, further comprising a movable carriage and wherein the application nozzle and the sensor are mounted on the movable carriage which is displaceable in a direction of the axis of symmetry of the application nozzle.

7. The device according to claim 4, wherein the sensor is an inductive sensor.

8. The device according to claim 4, wherein the sensor is a capacitive sensor.

9. The device according to claim 4, wherein the sensor is an optical sensor.

* * * * *